US006179105B1

(12) United States Patent
Haass

(10) Patent No.: US 6,179,105 B1
(45) Date of Patent: Jan. 30, 2001

(54) ELECTRICAL MODEL RAILWAY SET

(76) Inventor: Adolf Haass, Eichelhäherstr. 54, 81249 München, Deutschland (DE)

( * ) Notice: Under 35 U.S.C. 154(b), the term of this patent shall be extended for 0 days.

(21) Appl. No.: 09/085,695

(22) Filed: May 27, 1998

(30) Foreign Application Priority Data

May 28, 1997 (DE) ..... 197 22 451

(51) Int. Cl.[7] ..... B60M 1/00
(52) U.S. Cl. ..... 191/22 R; 104/DIG. 1
(58) Field of Search ..... 104/DIG. 1; 191/22 R, 191/23 R, 29 R, 23 A

(56) References Cited

U.S. PATENT DOCUMENTS 5,952,797 * 9/1999 Rossler ..... 104/DIG. 1

FOREIGN PATENT DOCUMENTS

PS 866 814 2/1953 (DE) .
42 25 277 C1 11/1993 (DE) ..... A63H/19/24

OTHER PUBLICATIONS

Official Letter From The German Patent Office dated Dec. 8, 1997 with English Translation.

* cited by examiner

*Primary Examiner*—Sherman Basinger
*Assistant Examiner*—Robert J. McCarry, Jr.
(74) *Attorney, Agent, or Firm*—Fish & Richardson P.C.

(57) ABSTRACT

In an electrical model railway set, increased electromagnetic compatibility is achieved by using AC motors without commutator and slip ring as drive motors for the model vehicles, wherein a simple structure of drive and drive control is attained by performing pulse control of polyphase stator windings of the AC motors of the model vehicles while employing the multi-channel control which is moreover customary in model railway sets.

38 Claims, 6 Drawing Sheets

ELECTRICAL MODEL RAILWAY SET

BACKGROUND OF THE INVENTION

The invention concerns an electrical model railway set having a stationary current source connected to tracks or to an overhead line, a stationary central station for generating control signals capable of being coupled to the tracks or to the overhead line, furthermore a plurality of model vehicles movable on the tracks, drawing electrical current from the tracks or from the overhead line, and drivable by electrical torque motors, as well as control signal receivers located on the respective model vehicles for extracting the control signals intended for a model vehicle and for supplying an adjustable electrical drive energy for the respective electrical torque motor for controlling the rotary speed thereof.

What is generally known are electrical model railway sets of this type, wherein DC motors or universal motors serve for driving the model vehicles, which receive the electrical drive energy through the tracks or through the overhead line and which are equipped with slip rings or commutators in order to feed electrical currents to the windings of the rotor.

The rotary speed of the motors for driving the model vehicles is obtained by controlling the terminal voltage, with control signals being encoded, e.g. digitally, in a central station, coupled to the tracks or to the overhead line, decoded in the single model vehicles by means of a decoder, and then controlling the terminal voltage of the electrical drive motors and thus the rotary speed thereof.

In recent years, digital controls for simultaneously operating a plurality of model vehicles on an electrical model railway set have become customary, with these digital controls serving not only for controlling the velocity of a plurality of model vehicles but also for actuating further consumers connected to the track system, such as points, signals and the like.

Model railway sets of the above considered type are discussed for example in DE-PS-42 25 277 and provide, for controlling portions of the set, the transmission of control signals via the tracks, with these control signals having to be regarded as data which present an address portion for allocation to the desired powered vehicles, and a data portion for determining direction of movement, moving velocity and possible special functions such as lighting.

Whereas the reception of electrical energy by the movable model vehicles from the tracks and from the overhead line may be devised to be substantially free of interference by suitable contacting constructions and associated auxiliary means, the use of DC motors or of universal motors having an analogous construction has the drawback of sparking occurring at the slip rings or commutators of these motors, with this sparking causing interferences in a very broad frequency band and thus being in contradiction with the requirements of electromagnetic compatibility (EMC).

Shielding the interferences induced by slip ring or commutator sparking on model vehicles causes considerable problems as these interferences also invade the entire line system which then acts as an antenna for interference signals.

DE-PS 866 814 describes a small-size rotary field motor or induction motor comprising in one of its embodiments a stator which can be supplied with polyphase current for generation of a rotary magnetic field, whereas the rotor does not comprise a slip ring. This known small-size motor is also intended for use in driving toy railways. Means for speed control of the small-size motor are not disclosed in the named patent specification.

SUMMARY OF THE INVENTION

The invention is to attain the objective of designing an electrical model railway set of the general construction defined in the introduction in such a way that electromagnetic compatibility during operation is improved at a comparatively simple structure, i.e., the interferences engendered by operation of the electrical torque motors of the model vehicles are reduced substantially.

The concept underlying the invention consists of not only replacing the universal motor or DC motor of known electrical model railway sets causing interferences with a synchronous or asynchronous motor which does not cause interferences, but moreover to employ the control system comprising a multiplicity of control channels, in particular a digital control system which is moreover already employed in electrical model railway sets with multiple-train control, in such a way that AC motors presenting a favorable behavior with respect to the interferences are rendered suitable for driving the model vehicles.

In general it should be noted here that, although primarily the use of synchronous motors as AC motors without slip rings or commutators in model vehicles is being disclosed in the following description of embodiments, the invention nevertheless also encompasses the use of asynchronous motors comprising cage rotors and of special types known per se, such as for example splitpole motors. It is of the essence in this context that the motors proposed here for driving the model vehicles are without slip ring or commutator and include a stator, the stator winding of which is capable of generating a rotary magnetic field. Where the speed of the rotary field does not conform with the rotor speed—as is true for the use of asynchronous motors—rotor speed control is mandatory in addition to the rotary magnetic field speed control carried out through the central station in the electrical model railway sets proposed here, particularly in order to realise a starting behavior of model vehicles which is desirable in a model railway set. A like speed control does, however, not cause any essential difficulties in an electrical model railway set of the presently described type inasmuch as operation of the utilised AC motors without slip rings or commutators in the present case moreover does not depend on the frequency of a power source connected to the tracks or overhead line, which may in the set described here optionally be a DC current source or an AC current source of internationally customary AC frequencies.

Herebelow embodiments and particular developments of the proposed electrical model railway set and of parts thereof shall be described by reference to the drawing, wherein:

BRIEF DESCRIPTION OF THE DRAWINGS

In the drawings, respective corresponding parts of the shown embodiments are provided with identical reference symbols.

DETAILED DESCRIPTION

Figure 1:
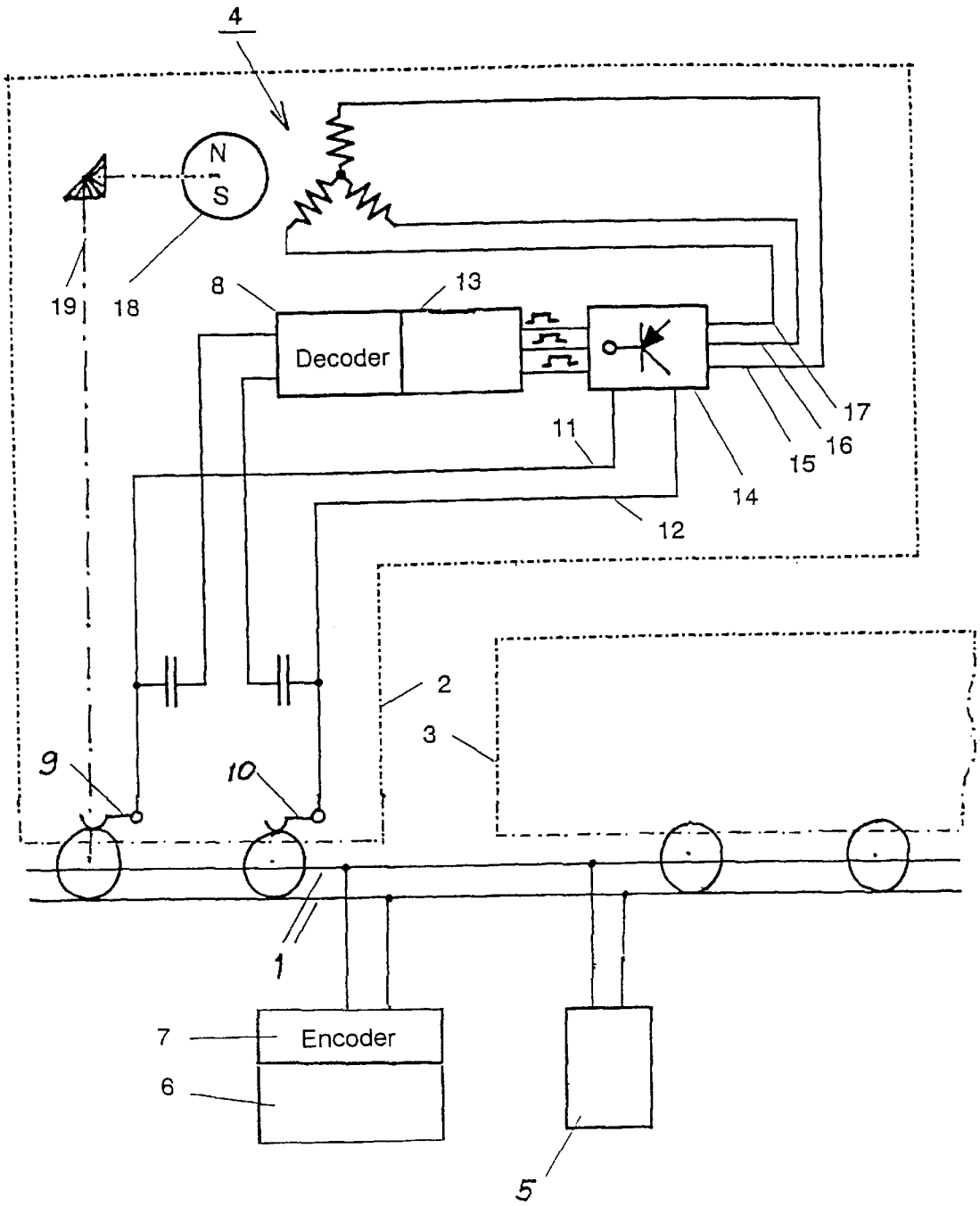
FIG. 1 shows an electrical model railway set in a simplified form and in schematic representation.

The electrical model railway set in accordance with FIG. 1 includes tracks or an overhead line 1 and model vehicles 2, 3 etc. which are movable on the tracks and are each driven by an electrical AC motor 4 without slip ring or commutator. To the tracks or to the overhead line an electrical current source 5 is connected which is a DC current source in the embodiment of FIG. 1. Moreover, a central station 6 is coupled to the tracks or overhead line 1. This central station serves for supplying control signals for the model vehicles 2, 3 etc. movable on the tracks, and for further consumers connected to the tracks, such as lighting, points or turnouts, signals and the like. Rejector circuits for keeping the voltage of the current source 5 from the central station 6 and for keeping the signals of the central station 6 from the current source 5 have been omitted in the drawing for the purpose of simplified representation. It should further be noted that the current source 5 and the central station 6 may also be combined in an apparatus unit in such a manner that a supply voltage having control signals modulated onto it is supplied to the tracks or to the overhead line via a single supply line, but in the present case a separate representation has been chosen for reasons of clarity.

The central station 6 includes an encoder 7 for encoding the control signals for the control signal receivers connected to the tracks or to the overhead line 1 in such a way that decoders 8 provided at the site of the control signal receivers are capable of extracting the control signals intended for the respective control signal receiver. Relevant details are known to the person having skill in the art and do not require a detailed description.

In the model vehicles, e.g. the model vehicle 2, sliding contact sets 9 and 10 substantially causing no electromagnetic interferences draw the direct voltage of the voltage source 5 present at the tracks or at the overhead line 1 as well as the control signals of the central station 6, so that the direct voltage and the control signals are available on the lines 11 and 12.

Via a decoupling network, which as a general rule is comprised of resistors or capacitors, there is connected to lines 11 and 12 the decoder 8 which extracts the control signals intended for the model vehicle 2 and supplies them to a pulse generator unit 13, the output lines of which supply in the schematically indicated manner rectangular wave switching pulse sequences which are phase-shifted relative to each other by 120° based on the full pulse period. The pulse frequency of the output pulse sequences of the pulse generator unit 13 is dependent on the control signals generated by the central station 6, encoded by the encoder 7, and finally extracted and decoded by the decoder, The switching pulse sequences generated by the pulse generator unit 13 subsequently arrive at a DC/AC converter 14 which is connected to the lines 11 and 12 conveying the direct voltage of the current source 5, and which transforms this direct voltage by means of three controllable valves into a three-phase AC voltage which is output onto the lines 15, 16, 17. The voltages on the lines 15, 16 and 17 each approximately have a rectangular wave shape as far as the idling conditions are concerned.

To the lines 15, 16 and 17, the three phases of a three-phase stator winding of the motor 4 are connected, with these three phases having a star connection configuration in the present embodiment. The rotor 18 associated with the stator has the form of a synchronous machine magnet wheel, the shaft of which drives a wheel set of the model vehicle 2 via a driving connection 19. The pulse frequency of the output pulse sequences of the pulse generator unit 13 determines the rotary speed of the rotary field generated by the stator of the synchronous motor 4 and thus the rotary speed of the rotor 18 in a clearly defined association.

In the embodiment described in connection with FIG. 1, the single phases of the stator winding are excited substantially by rectangular-wave type currents, for which reason the rotary field generated by the stator of the electromotor 4 is relatively inhomogeneous. This inhomogeneity may be eliminated by controlling the single phases of the stator winding of the motor 4 by a plurality of pulses modulated in their pulse width, which shall be treated in more detail further below.

It may, however, also be desirable to modify the amplitude of the current waves flowing through the lines 15, 16 and 17 in dependence on the rotary speed of the rotary field to be generated, for example in order to reliably realise a specific starting behavior of the synchronous motor 4 even in the case of an increased starting resistance of the model vehicle. In this case, when the valves of the DC/AC converter 14 are not operating in the saturation range, increased amplitudes of the current waves on the lines 15, 16 and 17 may be obtained by correspondingly greater switching pulses at the output of the pulse generator unit 13 which is influenced correspondingly for this purpose by additional control information from the central station 6.

Figure 2:
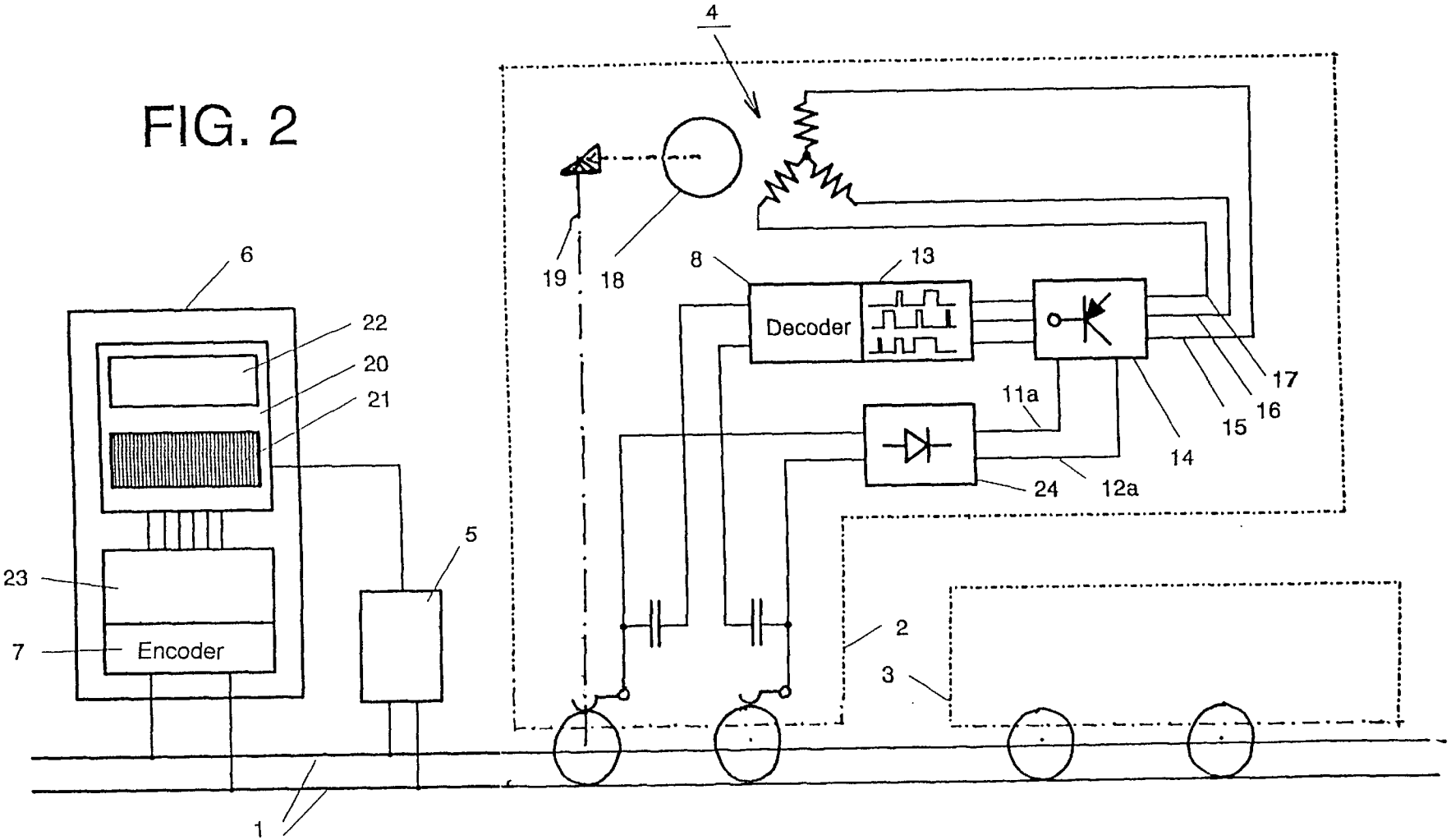
FIG. 2 shows a schematic representation of an embodiment further developed in comparison with FIG. 1.

In the representation of an embodiment according to FIG. 2 developed in comparison with FIG. 1, details of the central station 6 are indicated, The latter contains a control panel 20 having a keyboard 21 for manually inputting particular control instructions, as well as indicator means 22 for reproducing acknowledgments by consumers connected to the tracks or to the overhead line 1, wherein details of the signal paths for return conveying of the acknowledgement signals or acknowledgement information being omitted in the present description and in the drawings for the sake of simplicity of representation.

The control panel 20 is connected via a number of signal lines to control signal generating means 23 which contain pulse generators, analog/digital converters as well as multiplexing means and the encoder 7 mentioned above, In the embodiment according to FIG. 2, the current source 5 has the form of an AC current source which may be turned on and off and amplitude controlled from the control panel 20.

In each of the model vehicles 2 and 3, which are movable along the tracks or along the overhead line 1 just like in the embodiment according to FIG. 1, there is located a rectifier circuit 24 for transforming the AC voltage of the AC current source 5 into a direct voltage provided on output lines 11*a* and 12*a* of the rectifier circuit 24. This direct voltage, in a manner similar to the one in the embodiment according to FIG. 1, is supplied to a DC/AC converter 14 delivering on the output side, to lines 15, 16 and 17, AC voltages which are phase-shifted by 120° relative to each other and which excite in the three phases of the stator winding of the synchronous electrical motor 4 correspondingly phase-shifted magnetic fields that result in a rotary field acting on the magnet wheel 18 of the synchronous motor 4.

In variation from the embodiment according to FIG. 1, however, the pulse generator unit 13 of the embodiment according to FIG. 2 is formed such that it supplies to the DC/AC converter 14 not only rectangular-wave switching signals phase-shifted relative to each other by 120 electrical degrees, but in the manner of the operation of a switching controller supplies via three switching pulse lines a plurality of pulses having various pulse durations to the DC/AC converter 14, i.e. to the controllable electrical valves located therein, within one period of the AC voltage to be generated. Sequence and duration of the respective supplied switching pulses is selected such that the electrical valves of the DC/AC converter 14 are controlled open within the period of an alternating current to be generated such that the time integral over the pulse sequence, in relation to the level of the respective direct current mean value, approximates a sinusoidal oscillation.

By excitation of the three-phase stator winding of the synchronous motor 4 one thus obtains a comparatively harmonious rotary magnetic field.

The period of the sequence of output pulses of the pulse generator unit with a pulse duration variably selected in order to approximate a sinusoidal oscillation of the currents on lines 15, 16 and 17 is adjusted by a control instruction signal of the central station 6 extracted by the decoding means 8 for the pulse generator unit. This control instruction signal thus determines in a comparatively simple form the shapes and mutual associations of a multiplicity of control pulses at the output of the pulse generator unit 13, without a multiplicity of control signal transmission channels having to be provided on the way from the central station 6 to the model vehicle 2 or 3, etc.

Figure 3:
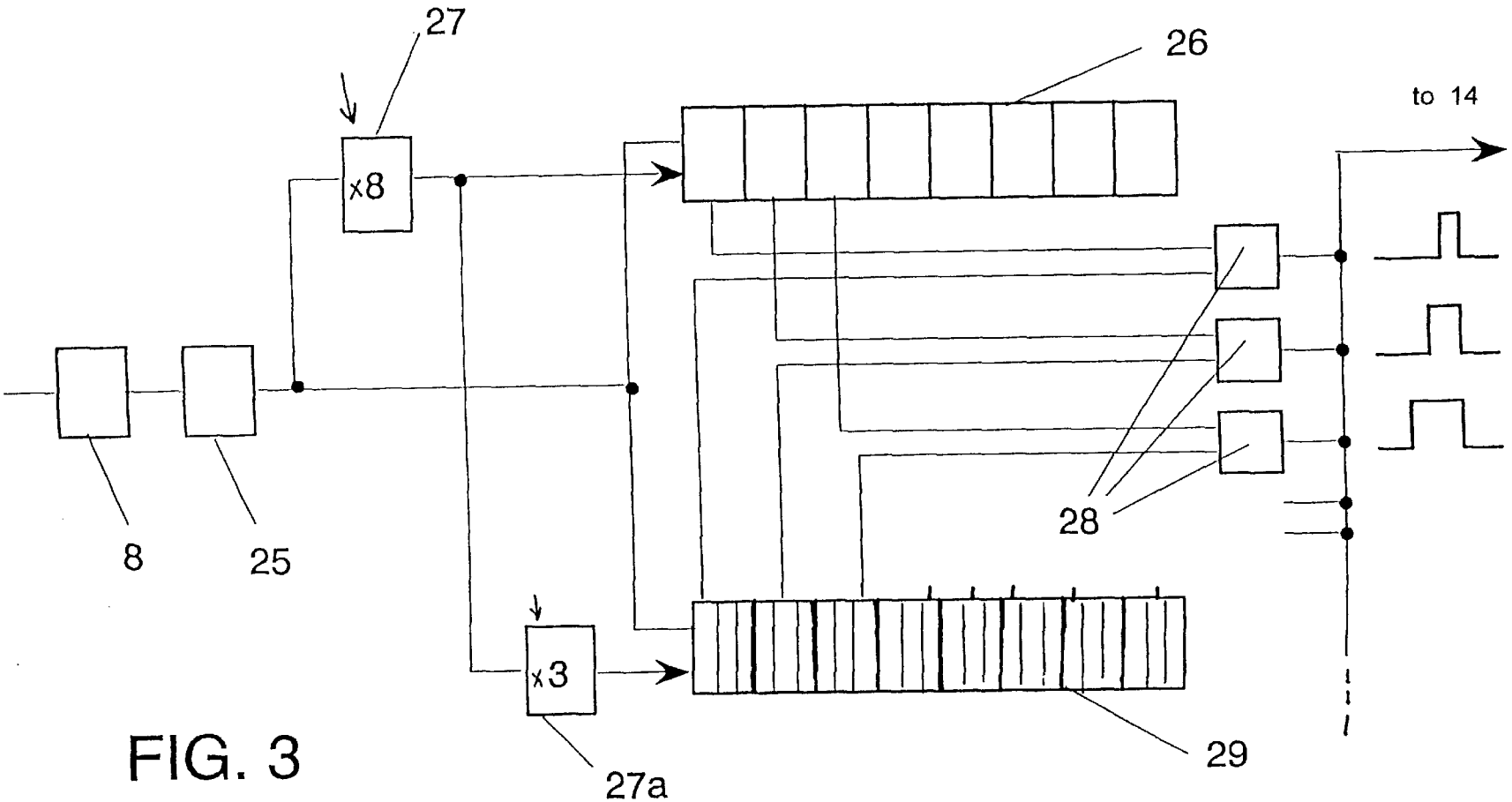
FIG. 3 shows a schematic circuit diagram of a pulse generator unit usable in the set in accordance with FIG. 2.

FIG. 3 shows a possible form of a part of the pulse generator unit 13 for the embodiment according to FIG. 2.

The decoder 8 supplies to a pulse generator 25 control signals which determine the pulse-repetition frequency of the output pulses of the pulse generator 25. The pulse generator 25 supplies at its output a pulse sequence having a pulse-repetition frequency corresponding to the rotary frequency of the rotary magnetic field to be generated by the stator of the synchronous motor 4. These output pulses of the pulse generator 25 activate a shift register 26, the clock input of which is supplied for progressing the input signal through the stages of the register from the output of the pulse generator 25 via a pulse multiplier 27. In the selected example, which merely serves for qualitative explanation, the pulse-repetition frequency of the pulse multiplier 27 is the eightfold of the pulse-repetition frequency of the output of pulse generator 25. Concurrently with progression of the trigger pulse of the shift register 26 through the stages thereof, the register stages each provide output signals which arrive, in the manner indicated in FIG. 3, at flipflops 28 and upon their arrival set these flipflops into the ON-condition.

Reset signals for the flipflops 28 are obtained from a shift register 29 operated in parallel with shift register 26. This shift register is excited substantially concurrently with the shift register 26 by the output of the pulse generator 25, however progressed at a timing which has a significantly higher frequency than the progressing timing for the shift register 26.

The shift register 26 has a number of stages in correspondence with the number of pulses used for approximating a period of a sinusoidal current on one of lines 15, 16 and 17, i.e. eight stages in the present example, for which reason the progressing timing of the pulse multiplier 27 is the eightfold of the timing at the output of the pulse generator 25.

The shift register 29 has a number of stage groups corresponding to the number of stages of the shift register 26, however within each stage group a number of single stages in correspondence with the number of pulses of different pulse lengths, which is desirable or required for approximating the sinusoidal current oscillation on one of lines 15, 16 and 17 within a pulse sequence of eight pulses in correspondence with a period of this sinusoidal oscillation. In the present case merely three different pulse time lengths were selected. Accordingly, the shift register 29 altogether has twenty-four stages grouped into eight register stage groups. The progressing clock frequency of the shift register 29 is the twenty-four-fold of the output pulse-repetition frequency of the pulse generator 25, for which purpose a pulse multiplier 27*a* triples the pulse-repetition frequency at the output of the pulse multiplier 27.

It can thus be seen that the excitation pulses for the shift registers 26 and 29, which are derived from the output of the pulse generator 25, pass through these registers in identical time periods owing to the different clock frequencies.

The reset signals for the flipflop circuits 28 are now derived from register stage groups of register 29 (corresponding to certain ones of the register stages of register 26), so that switching pulses having a modulated time pulse width capable of being combined on an output line of the pulse generator unit 13 are obtained at the outputs of the flipflop circuits 28. Other groups of actuating signals and reset signals for other groups of flipflop circuits result in switching pulse sequences having, for example, a relative phase shift of 120° with the above described sequence of pulses of different time lengths, such that the stator windings of the synchronous motor 4 supplied at a phase shift of 120 electrical degrees are capable of generating a rotary magnetic field having good homogeneity.

It should be noted that the respective phase shifts of the switching pulse sequences for the inputs of the DC/AC converter 14 allocated to the single conductors of the stator winding are readily maintained without any additional control intervention when the pulse-repetition frequency of the pulse generator 25 is modified in the case of the embodiment according to FIG. 3. Tapping the reset signal for the flipflop circuits 28 of single register stages of the shift register 29 at the beginning, middle or end of groups determines the relative pulse length in time independently of the output frequency of the pulse generator 25.

Figure 4A:
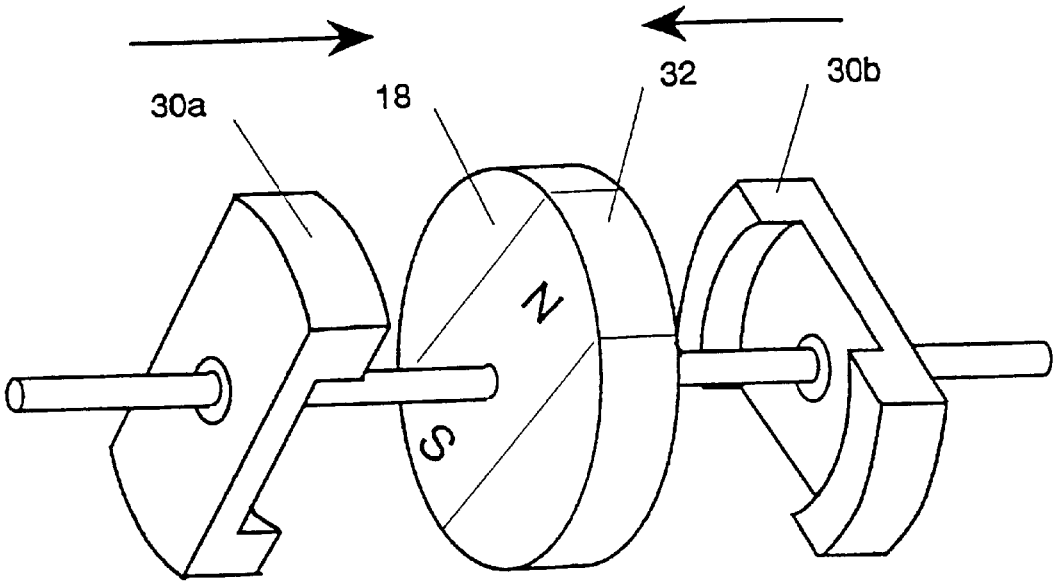
FIG. 4*a* shows, in a similar representation, an embodiment of a synchronous motor modified in comparison with FIG. 4.
Figure 4:
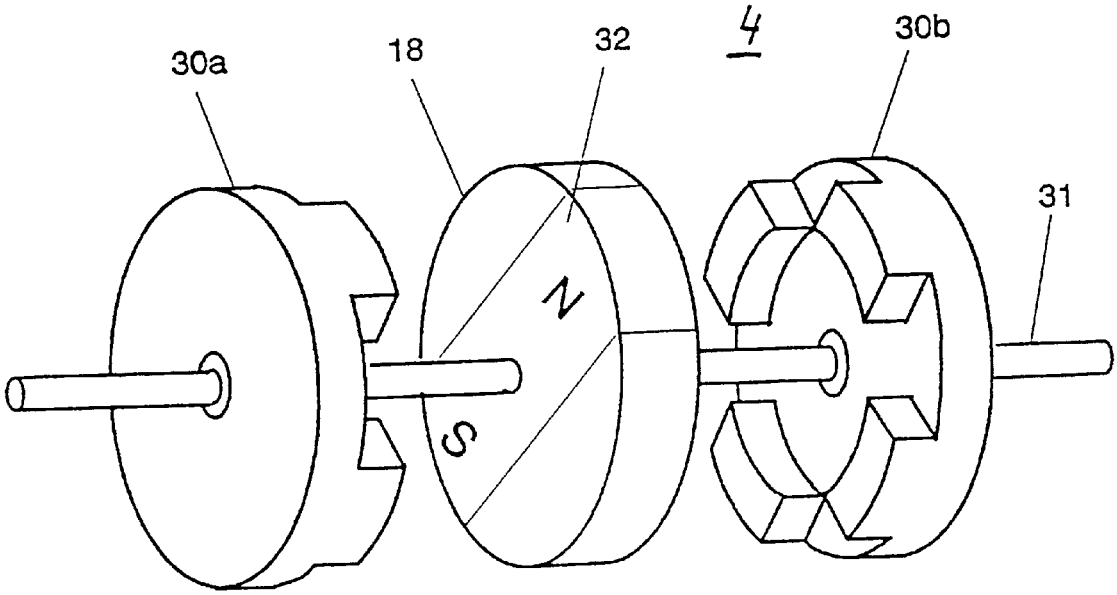
FIG. 4 shows a schematic perspective representation of a synchronous motor usable as a drive for a model vehicle of electrical model railway sets of the presently described type, with the parts thereof being drawn apart in the direction of the drive shaft.

The representation of FIG. 4 shows, drawn apart in the axial direction, a synchronous motor 4 having a stator divided in two in the axial direction, which comprises stator parts 30*a* and 30*b*. The stator parts 30*a* and 30*b* each contain an annular yoke and polepieces projecting therefrom in the axial direction, opposing each other, having the shape of a circle ring sector in a radial section, which are each surrounded, as is, however, not represented in FIG. 4, by attached flat coils whose coil openings have the shape of a circle ring sector in a radial section.

Between the stator parts 30*a* and 30*b* there is the magnet wheel 18 of the synchronous motor 4 seated on the motor shaft 31 and having a permanent magnet 32 magnetised in a suitable manner and extending through the magnet wheel, which may be comprised of ferritic material.

Figure 6:
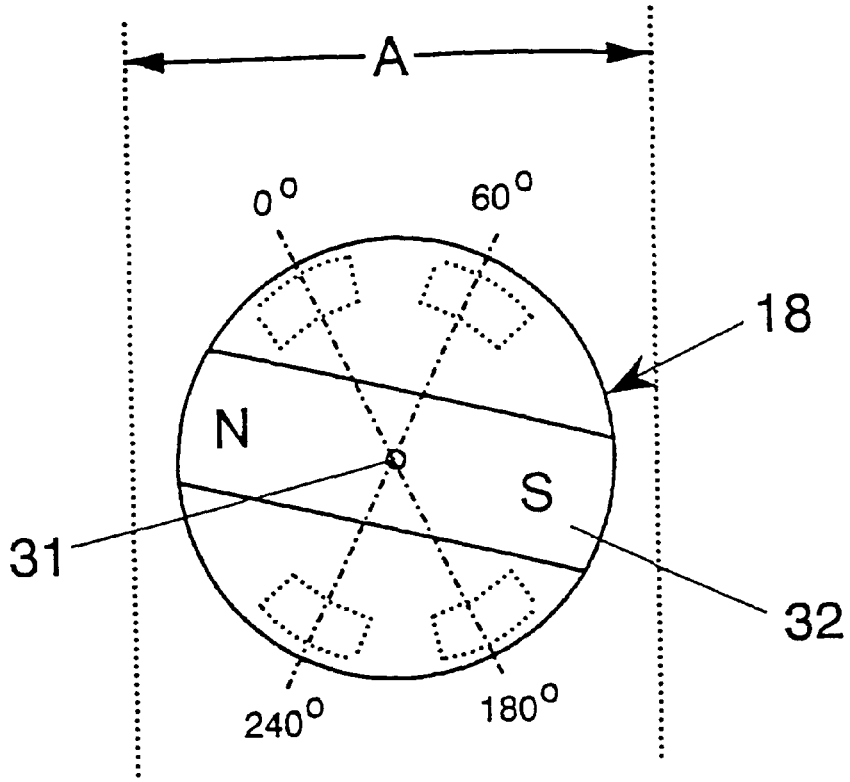
FIG. 6 is a schematic view of the rotor of the synchronous motor of FIG. 4 or 4*a* indicating the stator poles.

The arrangement of the poles of stator parts 30*a* and 30*b* projecting toward the magnet wheel 18 and of the magnet wheel 18 itself can be taken from the front view in accordance with FIG. 6, In contrast with the customary orientation of the pole center axes of three-phase stator pole arrangements of synchronous machines, in the embodiment in accordance with FIGS. 4 and 6 a stator pole configuration was chosen wherein the single poles have a geometrical orientation at 0°, 60°, 180° and 240° with respect to the axis of the motor shaft 31. Additional customary polepieces provided for a stator winding having a number 2 of pole pairs of in the geometrical positions of 120° and 300° were omitted in the embodiment in accordance with FIGS. 4 and 5. The windings surrounding the polepieces in the 0°, 60°, 180° and 240° positions are excited by correspondingly controllling the DC/AC converter 14, which in this case comprises four output lines or four pairs of output lines, such that the stator arrangement consisting of stator parts 30*a* and 30*b* generates an intense and comparatively homogeneous rotary magnetic field in the space between the axially opposed polepieces. By omitting additional polepieces in the geometrical positions corresponding to 120° and 300°, it is achieved in the embodiment of a synchronous motor in accordance with FIGS. 4 and 6 that the motor has comparatively small dimensions in the distance A between the dash-colon-dash marking lines, i.e. it is long and slim, which is very expedient for mounting in model vehicles, e.g. in model railway locomotives.

FIG. 4*a* shows an embodiment of a synchronous motor modified in comparison with FIG. 4, comprising a stator divided in two in the axial direction, , wherein the stator parts are again designated by 30*a* and 30*b*. Due to the drawn-apart representation in the axial direction, the stator parts 30*a* and 30*b* are at a great distance from the synchronous machine magnet wheel 18, however face it at a small distance with their polepieces having a ring sector-shaped radial section when the arrangement is folded telescopically as is indicated by arrows.

Other than in the embodiment according to FIG. 4, the stator parts 30*a* and 30*b* each comprise only one pair of mutually opposing polepieces having a circle ring sector-shaped radial section. The stator parts are shaped identically, however mounted around the axis 31 in an arrangement staggered by 60°. The stator windings allocated to the polepieces, or the pole pairs of the stator parts 30*a* and 30*b* of FIG. 4*a*, are excited in such a way that a rotary field entering into interaction with the synchronous machine magnet wheel 16 results, bringing about conditions similar to those described in connection with the embodiment according to FIGS. 4 and 6. The embodiment according to FIG. 4*a*, too, is characterised by a space-saving design (FIG. 6, dimension A) and has the advantage of simple and cost-efficient manufacture due to identical formation of the stator parts.

Instead of the synchronous magnet wheel 18, it is also possible to provide between the stator parts 30*a* and 30*b* an asynchronous motor cage rotor having a flat disk-shape outwardly corresponding to the shape of magnet wheel 18, wherein the short-circuiting rings of the cage rotor shown under 33 are formed relative to the motor shaft 31 by a hub on the one hand and by an outer ring of spokes on the other hand, and the intermediate, radially extending spokes forming the rotor bars of the cage rotor.

Where asynchronous motors, the stator windings of which are actuated by a pulse generator unit 13, are used in electrical model railway sets of the presently described type, the speed-torque characteristic of asynchronous machines necessitates carrying out speed control, whereas in the case of using synchronous motors as drive motors for the model vehicles a pure rotary speed control by controlling the rotary speed of the rotary magnetic field of the stators may be performed, inasmuch as the rotary speed of the magnet wheel always has to be synchronous with the rotation of the rotary field.

Figure 5:
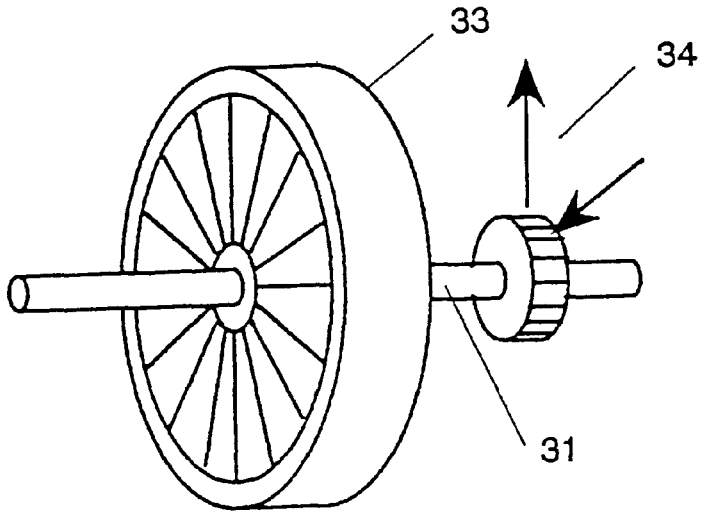
FIG. 5 is a perspective view of a cage rotor usable in combination with stator parts in accordance with FIG. 4 or 4*a* for formation of an asynchronous motor.

As is indicated in FIG. 5 in a purely schematic manner, in speed control of the asynchronous motors to be used, a motor-speed actual-value sensor 34, for example an electro-optical synchro, an inductive synchro or a capacitive synchro is provided, whose actual-value signals for the rotary speed are retransmitted to the pulser 25 for completion of a control loop. It is also possible to devise voltages induced in stator winding parts that are not subjected to pulses as rotary-speed current-value signals and return them to the pulser 25 for the purpose of speed control. Speed control, in particular for the realisation of a particular starting behavior of the model vehicles, is performed in such a way that—depending on a desired rotary speed or a rotary speed to be attained—specific speed-torque characteristics of the asynchronous motor subjected to a varying frequency are selected by determining a specific rotary frequency of the rotary magnetic field generated in the stator, such that for example by starting out from the static torque a respective characteristic is made to bear which prevents a rise or decrease of a particular driving speed.

Figure 7:
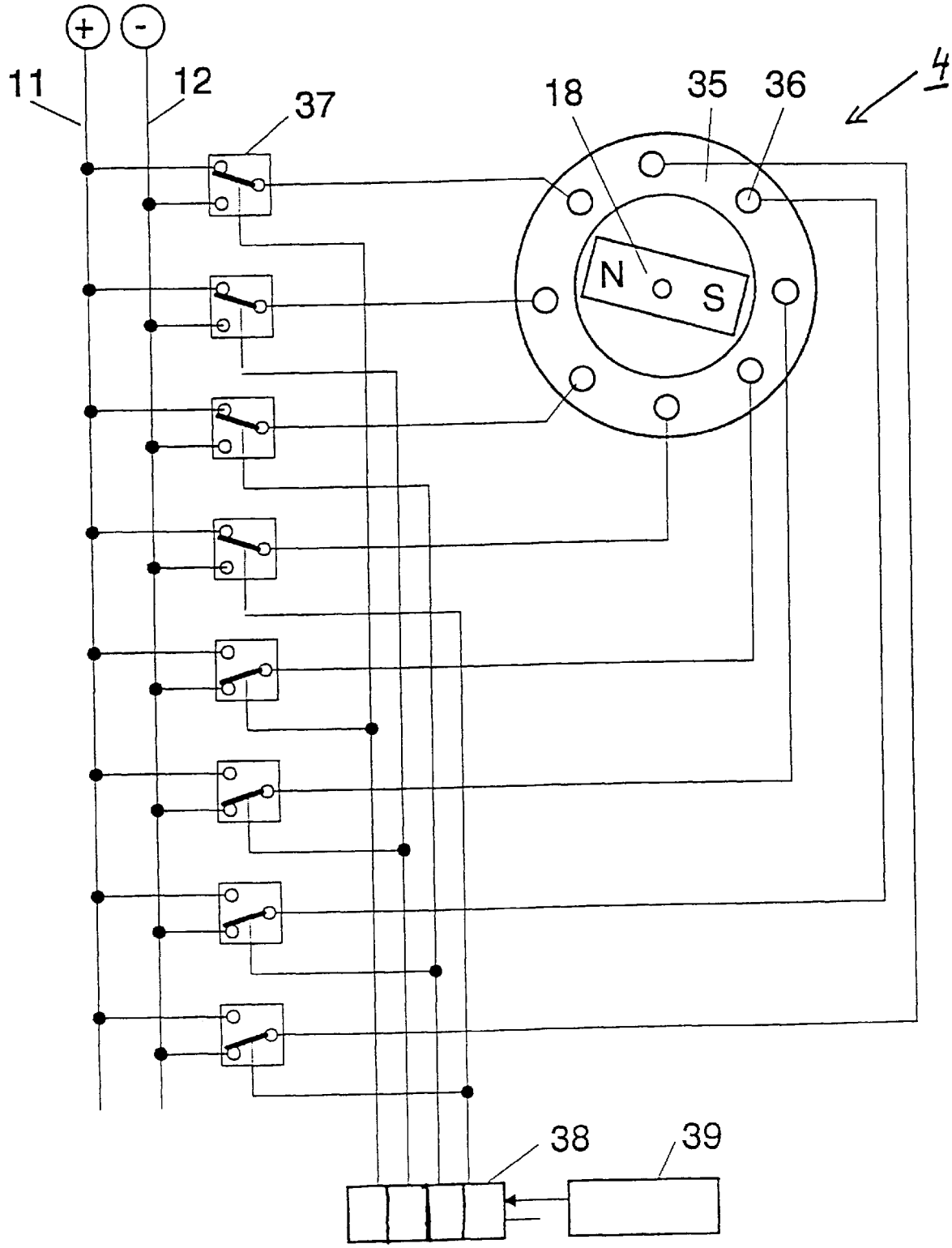
FIG. 7 is a schematic view of a synchronous motor, the stator winding of which may be controlled in correspondence with the operation of a stepping motor.

There is finally the possibility in accordance with FIG. 7 of providing a synchronous motor 4 serving for driving the model vehicles with a stator 35 on which conductor bars 36 extending in the axial direction are arranged in distribution over the inner periphery, for which purpose corresponding grooves are provided in the core assembly of the stators. The single conductor bars 36 are connected to a common return line on the side of the stator 35 located behind the plane of drawing of FIG. 7, and on the side of the stator 35 facing the viewer in the manner shown in FIG. 7 they are each connected to electronic changeover switches 37 which perform connection of single conductor bars 36 either to the line 11 conducting a positive potential or to the line 12 conducting a negative potential. The switch positions of the electronic changeover switches 37 are capable of being set, by switching signals from the single stages of a register 38, from the currently provided switching condition into the respective other switching condition, with conductor bars 36 diametrally opposed in the stator 35 concurrently being subjected to being changed in the manner indicated in FIG. 7.

By controlling the clock frequency for progressing of the register 38 by means of the clock pulse generator 39, a rotary magnetic field having a specific rotary speed is generated by the conductor bars 36 altogether owing to the direction of a respective flow of current, with this rotary field entering into interaction with the magnet wheel 18. The drive according to FIG. 7 thus realises a rotary stepping motor having a comparatively simple design.

What is claimed is:

1. An electrical model railway set comprising a current source (5) connected to tracks or to an overhead line (1), a stationary central station (6) for generating control signals which are capable of being coupled to the tracks or to the overhead line, a plurality of model vehicles (2, 3) movable on the tracks (1), each drawing electrical current from the tracks or from the overhead line (1) and capable of being driven by electrical torque motors (4), and control signal receivers (8, 13) located on said model vehicles, for extracting the control signals intended for a model vehicle (2, 3) and for supplying an adjustable electrical drive energy for the respective electrical torque motor, to control the rotary speed thereof, characterised in that the electrical torque motor is an AC motor (4) without slip ring or commutator, a stator of which presenting several windings is formed such as to generate a rotary magnetic field, and said control signal receiver (8, 13) contains a pulse generator unit (13) which applies to the stator windings of the electrical torque motor (4) pulses, the relative phase position of which is adjustable by means of the control signals of said central station (6) supplied to said pulse generator unit (13) in such a way that the rotary speed of the rotary field can be controlled.

2. The electrical model railway set in accordance with claim 1, characterised in that the pulses supplied by said pulse generator unit (13) are adjustable with respect to their relative phase position as well as their duration by means of the control signals of said central station (6) which are conveyed to the pulse generator unit.

3. The electrical model railway set in accordance with claim 1 or 2, characterised in that the control signals emitted by said central station (6) are coupled to the tracks or to the overhead line (1) via a multiplexer and encoder (7), and that said pulse generator unit (13) is fed by a demultiplexer and decoder (8).

4. The electrical model railway set according to one of claims 1 or 2, characterised in that said current source (5) is an AC current source, and that on each respective one of said model vehicles (2, 3) a rectifier circuit (24) for feeding a DC/AC converter (14) controlled by said pulse generator unit (13) and connected to the stator winding of said AC motor (4).

5. The electrical model railway set according to one of claims 1 or 2, characterised in that said current source is a DC current source (5), the voltage of which can be drawn from said tracks or from said overhead line (1) in said model vehicles (2, 3) via sliding contacts and is supplied to a DC/AC converter circuit (14) controlled by said pulse generator unit (13).

6. The electrical model railway set according to one of claims 1 or 2, characterised in that said pulse generator unit (13), in dependence on control signals determining the rotary speed of the rotary magnetic field of the stator winding of said AC motor (4), supplies to a, or the, DC/AC converter circuit (14) a number of pulse sequences corresponding to the number of phases of the stator winding, which are electrical phase-shifted relative to each other in correspondence with the geometrical position of the phase conductors of the stator winding, with the pulse time periods in the pulse sequences being modulated in the respective phase conductor to approximate the respective phase current to a sinusoidal current development in accordance with the time integral over the pulse sequence in relation to the respective direct current mean value.

7. The electrical model railway set according to one of claims 1 or 2, characterised in that said AC motor of said model vehicles is a synchronous motor (4).

8. The electrical model railway set according to one of claims 1 or 2, characterised in that said AC motor of said model vehicles is an asynchronous motor.

9. The electrical model railway set in accordance with claim 1 or 2, characterized in that the stator is constituted by two identical stator parts (30*a*, 30*b*) arranged at a distance in the axial direction, the poles of which are surrounded by the phase windings, extend in the axial direction, originate from respective stator yoke parts, are arranged in opposition to each other or staggered in the peripheral direction, define a relatively flat cylindrical spacing wherein a synchronous machine magnet wheel (18) or an asynchronous machine cage rotor (33) is mounted rotatably on a motor shaft (31) axially extending through said stator parts.

10. The electrical model railway set according to one of claims 1 or 2, characterised in that the phase conductors of the polyphase stator windings of said AC motor (4) of said model vehicles (2, 3) are concentrated on diametrically opposed peripheral regions of the stator inner periphery, such that with respect to a radial cross-sectional plane the transverse dimension (A) of r periphery respective AC motor is reduced, and that the single phase condustors in accordance with their geometrical radial angular position are energised at a relative phase-shift relative to each other for generation of a substantially homogeneous rotary magnetic field (FIG. 6).

11. The electrical model railway set in accordance with claim 1 or 2, characterised in that the stator windings of said AC motor (4) contain axially extending conductor bars (36) in equal distribution at the periphery, of which one group located on one stator side may be connected to a DC potential of one sign and the opposite group may be connected to a DC potential of the opposite sign (37), and diametrically opposed conductor bars are exchangeable with respect to their connection to different potential progressing in the direction of revolution, such that a synchronous machine magnet wheel (18) allocated to the stator is synchronously entrained by the magnetic field generated by said energised conductor bars (36) and progressing in the direction of rotation (FIG. 7).

12. The electrical model railway set according to claim 3, characterized in that said current source (5) is an AC current source, and that on each respective one of said model vehicles (2, 3) a rectifier circuit (24) for feeding a DC/AC converter (14) controlled by said pulse generator unit (13) and connected to the stator winding of said AC motor (4).

13. The electrical model railway set according to claim 3, characterized in that said current source is a DC current source (5), the voltage of which can be drawn from said tracks or from said overhead line (1) in said model vehicles (2, 3) via sliding contacts and is supplied to a DC/AC converter circuit (14) controlled by said pulse generator unit (13).

14. The electrical model railway set according to claim 3, characterized in that said pulse generator unit (13), in dependence on control signals determining the rotary speed of the rotary magnetic field of the stator winding of said AC motor (4), supplies to a, or the, DC/AC converter circuit (14) a number of pulse sequences corresponding to the number of phases of the stator winding, which are electrical phase-shifted relative to each other in correspondence with the geometrical position of the phase conductors of the stator winding, with the pulse time periods in the pulse sequences being modulated in the respective phase conductor to approximate the respective phase current to a sinusoidal current development in accordance with the time integral over the pulse sequence in relation to the respective direct current mean value.

15. The electrical model railway set according to claim 4, characterized in that said pulse generator unit (13), in dependence on control signals determining the rotary speed of the rotary magnetic field of the stator winding of said AC motor (4), supplies to a, or the, DC/AC converter circuit (14)

a number of pulse sequences corresponiding to the number of phases of the stator winding, which are electrical phase-shifted relative to each other in correspondence with the geometrical position of the phase conductors of the stator winding, with the pulse time periods in the pulse sequences being modulated in the respective phase conductor to approximate the respective phase current to a sinusoidal current development in accordance with the time integral over the pulse sequence in relation to the respective direct current mean value.

16. The electrical model railway set according to claim 5, characterized in that said pulse generator unit (13), in dependence on control signals determining the rotary speed of the rotary magnetic field of the stator winding of said AC motor (4), supplies to a, or the, DC/AC converter circuit (14) a number of pulse sequences corresponding to the number of phases of the stator winding, which are electrical phase-shifted relative to each other in correspondence with the geometrical position of the phase conductors of the stator winding, with the pulse time periods in the pulse sequences being modulated in the respective phase conductor to approximate the respective phase current to a sinusoidal current development in accordance with the time integral over the pulse sequence in relation to the respective direct current mean value.

17. The electrical model railway set according to claim 3, characterized in that said AC motor of said model vehicles is a synchronous motor (4).

18. The electrical model railway set according to claim 4, characterized in that said AC motor of said model vehicles is a synchronous motor (4).

19. The electrical model railway set according to claim 5, characterized in that said AC motor of said model vehicles is a synchronous motor (4).

20. The electrical model railway set according to claim 6, characterized in that said AC motor of said model vehicles is a synchronous motor (4).

21. The electrical model railway set according to claim 3, characterized in that said AC motor of said model vehicles is an asynchronous motor.

22. The electrical model railway set according to claim 4, characterized in that said AC motor of said model vehicles is an asynchronous motor.

23. The electrical model railway set according to claim 5, characterized in that said AC motor of said model vehicles is an asynchronous motor.

24. The electrical model railway set in accordance with claim 3, characterized in that the stator is constituted by two identical stator parts **(30*a*, 30*b*) arranged at a distance in the axial direction, the poles of which are surrounded by the phase windings, extend in the axial direction, originate from respective stator yoke parts, are arranged in opposition to each other or staggered in the peripheral direction, define a relatively flat cylindrical spacing wherein a synchronous machine magnet wheel (18) or an asynchronous machine cage rotor (33) is mounted rotatably on a motor shaft (31)** axially extending through said stator parts.

25. The electrical model railway set in accordance with claim 4, characterized in that the stator is constituted by two identical stator parts **(30*a*, 30*b*) arranged at a distance in the axial direction, the poles of which are surrounded by the phase windings, extend in the axial direction, originate from respective stator yoke parts, are arranged in opposition to each other or staggered in the peripheral direction, define a relatively flat cylindrical spacing wherein a synchronous machine magnet wheel (18) or an asynchronous machine cage rotor (33) is mounted rotatably on a motor shaft (31)** axially extending through said stator parts.

26. The electrical model railway set in accordance with claim 5, characterized in that the stator is constituted by two identical stator parts **(30*a*, 30*b*) arranged at a distance in the axial direction, the poles of which are surrounded by the phase windings, extend in the axial direction, originate from respective stator yoke parts, are arranged in opposition to each other or staggered in the peripheral direction, define a relatively fiat cylindrical spacing wherein a synchronous machine magnet wheel (18) or an asynchronous machine cage rotor (33) is mounted rotatably on a motor shaft (31)** axially extending through said stator parts.

27. The electrical model railway set in accordance with claim 6, characterized in that the stator is constituted by two identical stator parts **(30*a*, 30*b*) arranged at a distance in the axial direction, the poles of which arc surrounded by the phase windings, extend in the axial direction, originate from respective stator yoke parts, are arranged in opposition to each other or staggered in the peripheral direction, define a relatively flat cylindrical spacing wherein a synchronous machine magnet wheel (18) or an asynchronous machine cage rotor (33) is mounted rotatably on a motor shaft (31)** axially extending through said stator parts.

28. The electrical model railway set in accordance with claim 7, characterized in that the stator is constituted by two identical stator parts **(30*a*, 30*b*) attained at a distance in the axial direction, the poles of which are surrounded by the phase windings, extend in the axial direction, originate from respective stator yoke parts, are arranged in opposition to each other or staggered in the peripheral direction, define a relatively flat cylindrical spacing wherein a synchronous machine magnet wheel (18) or an asynchronous machine cage rotor (33) is mounted rotatably on a motor shaft (31)** axially extending through said stator parts.

29. The electrical model railway set in accordance with claim 8, characterized in that the stator is constituted by two identical stator parts **(30*a*, 30*b*) arranged at a distance in the axial direction, the poles of which are surrounded by the phase windings, extend in the axial direction, originate from respective stator yoke parts, are arranged in opposition to each other or staggered in the peripheral direction, define a relatively flat cylindrical spacing wherein a synchronous machine magnet wheel (18) or an asynchronous machine cage rotor (33) is mounted rotatably on a motor shaft (31)** axially extending through said stator parts.

30. The electrical model railway set according to claim 3, characterized in that the phase conductors of the polyphase stator windings of said AC motor (4) of said model vehicles (2, 3) are concentrated on diametrically opposed peripheral regions of the stator inner periphery, such that with respect to a radial cross-sectional plane the transverse dimension (A) of r periphery respective AC motor is reduced, and that the single phase conductors in accordance with their geometrical radial angular position are energized at a relative phase-shift relative to each other for generation of a substantially homogeneous rotary magnetic field (FIG. 6).

31. The electrical model railway set according to claim 4, characterized in that the phase conductors of the polyphase stator windings of said AC motor (4) of said model vehicles (2, 3) are concentrated on diametrically opposed peripheral regions of the stator inner periphery, such that with respect to a radial cross-sectional plane the transverse dimension (A) of r periphery respective AC motor is reduced, and that the single phase condustors in accordance with their geometrical radial angular position are energized at a relative phase-shift relative to each other for generation of a substantially homogeneous rotary magnetic field (FIG. 6).

32. The electrical model railway set according to claim 5, characterized in that the phase conductors of the polyphase stator windings of said AC motor (4) of said model vehicles (2, 3) are concentrated on diametrically opposed peripheral regions of the stator inner periphery, such that with respect to a radial cross-sectional plane the transverse dimension (A) of r periphery respective AC motor is reduced, and that the single phase conductors in accordance with their geometrical radial angular position are energized at a relative phase-shift relative to each other for generation of a substantially homogeneous rotary magnetic field (FIG. 6).

33. The electrical model railway set according to claim 6, characterized in that the phase conductors of the polyphase stator windings of said AC motor (4) of said model vehicles (2, 3) are concentrated on diametrically opposed peripheral regions of the stator inner periphery, such that with respect to a radial cross-sectional plane the transverse dimension (A) of r periphery respective AC motor is reduced, and that the single phase conductors in accordance with their geometrical radial angular position are energized at a relative phase-shift relative to each other for generation of a substantially homogeneous rotary magnetic field (FIG. 6).

34. The electrical model railway set according to claim 7, characterized in that the phase conductors of the polyphase stator windings of said AC motor (4) of said model vehicles (2, 3) are concentrated on diametrically opposed peripheral regions of the stator inner periphery, such that with respect to a radial cross-sectional plane the transverse dimension (A) of r periphery respective AC motor is reduced, and that the single phase conductors in accordance with their geometrical radial angular position are energized at a relative phase-shift relative to each other for generation of a substantially homogeneous rotary magnetic field (FIG. 6).

35. The electrical model railway set according to claim 8, characterized in that the phase conductors of the polyphase stator windings of said AC motor (4) of said model vehicles (2, 3) are concentrated on diametrically opposed peripheral regions of the stator inner periphery, such that with respect to a radial cross-sectional plane the transverse dimension (A) of r periphery respective AC motor is reduced, and that the single phase conductors in accordance with their geometrical radial angular position are energized at a relative phase-shift relative to each other for generation of a substantially homogeneous rotary magnetic field (FIG. 6).

36. The electrical model railway set in accordance with claim 3, characterized in that the stator windings of said AC motor (4) contain axially extending conductor bars (36) in equal distribution at the periphery, of which one group located on one stator side may be connected to a DC potential of one sign and the opposite group may be connected to a DC potential of the opposite sign (37), and diametrically opposed conductor bards are exchangeable with respect to their connection to different potential progressing in the direction of revolution, such that a synchronous machine magnet wheel (18) allocated to the stator is synchronously entrained by the magnetic field generated by said energized conductor bars (36) and progressing in the direction of rotation (FIG. 7).

37. The electrical model railway set in accordance with claim 4, characterized in that the stator windings of said AC motor (4) contain axially extending conductor bars (36) in equal distribution at the periphery, of which one group located on one stator side may be connected to a DC potential of one sign and the opposite group may be connected to a DC potential of the opposite sign (37), and diametrically opposed conductor bards are exchangeable with respect to their connection to different potential progressing in the direction of revolution, such that a synchronous machine magnet wheel (18) allocated to the stator is synchronously entrained by the magnetic field generated by said energized conductor bars (36) and progressing in the direction of rotation (FIG. 7).

38. The electrical model railway set in accordance with claim 5, characterized in that the stator windings of said AC motor (4) contain axially extending conductor bars (36) in equal distribution at the periphery, of which one group located on one stator side may be connected to a DC potential of one sign and the opposite group may be connected to a DC potential of the opposite sign (37), and diametrically opposed conductor bards are exchangeable with respect to their connection to different potential progressing in the direction of revolution, such that a synchronous machine magnet wheel (18) allocated to the stator is synchronously entrained by the magnetic field generated by said energized conductor bars (36) and progressing in the direction of rotation (FIG. 7).

* * * * *